United States Patent [19]

Pham

[11] Patent Number: 4,577,074

[45] Date of Patent: Mar. 18, 1986

[54] HIGH VOLTAGE GAS-BLAST CIRCUIT BREAKER

[75] Inventor: Van Doan Pham, Meyzieu, France

[73] Assignee: Alsthom-Atlantique, Paris, France

[21] Appl. No.: 691,042

[22] Filed: Jan. 14, 1985

[30] Foreign Application Priority Data

Jan. 13, 1984 [FR] France ..... 84 00474

[51] Int. Cl.[4] ..... H01H 33/88

[52] U.S. Cl. ..... 200/148 A; 200/148 R; 200/150 G

[58] Field of Search ..... 200/148 A, 148 R, 150 G

[56] References Cited

U.S. PATENT DOCUMENTS 4,486,632 12/1984 Neimeyer et al. ..... 200/150 G
4,514,605 4/1985 Pham ..... 200/148 R

FOREIGN PATENT DOCUMENTS 1127442 4/1962 Fed. Rep. of Germany .
2948976 2/1981 Fed. Rep. of Germany .
7636649 6/1978 France .

*Primary Examiner*—Robert S. Macon
*Attorney, Agent, or Firm*—Sughrue, Mion, Zinn, Macpeak, and Seas

[57] ABSTRACT

The gas-blast type high voltage circuit breaker includes a first volume (27) in which gas pressure is increased due to heating by the breaking arc, the gas in this volume escaping to blow out the arc at current zero of the current being interrupted, and a second volume (37) in which the gas is compressed by a piston (39) at the beginning of the breaker opening phase, said gas being directed at the arc during the following phases. Circuit breaker further comprises main fixed contacts (21), fixed arcing contacts (24), main moving contacts and moving arcing contacts, the arc extending between the arcing contacts as the circuit breaker opens, said first volume (27) and second volume (37) being disposed to each side of the arcing region, being annular and ending in nozzles (26, 42) which direct separate jets of gas to the two respective roots of the arc.

6 Claims, 6 Drawing Figures

HIGH VOLTAGE GAS-BLAST CIRCUIT BREAKER

FIELD OF THE INVENTION

This invention relates to a compressed-gas type high voltage circuit breaker the interrupting chamber whereof comprises a volume in which the arc-blasting gas becomes heated by the breaking arc and consequently increases in pressure and is used to extinguish the arc by being released at the amount when the value of the current to be interrupted goes to zero. The gas used can be sulfur hexafluoride, for example.

BACKGROUND OF THE INVENTION

A circuit breaker of the type just mentioned was described in Assignee's French patent application No. 82 00034, dated Jan. 5, 1982. In that design, said gas volume is annular and bounded by the inside wall of a gas blast nozzle and by a baffle or deflector coaxial with the nozzle.

The above-mentioned circuit breaker is illustrated in partial half-cross-section in FIG. 1, the various reference numbers therein designating the following items:

1: Main fixed contact (1—in open position; 1'—in closed position)
2: Fixed arcing contact
3: Main moving contact
4: Insulating gas blast nozzle
5: Coaxial deflector
6: Openings between volumes 9 and 13
7: Fingers of main moving contacts
8: Tubular portion of moving contact; 8A—end of contact tubular portion
9: Annular cross-section volume for thermal effect
9A: Annular volume adjacent to volume 9
10A: Annular passage for hot gas providing arc blasting by thermal effect
10B: Annular passage for gas from compressed gas blast nozzle
12: Fixed puffer piston
13: Compression volume
14: Annular blasting duct.

It can be seen that, on opening of the breaker, the arc which forms between the fixed arc contact 2 and contact 8A is blasted with gas coming from volumes 9 and 13. Volume 9 contains gas which is compressed as a result of heating by the arc and is therefore called the thermal volume; volume 13 carries air moved by the piston 12 and accordingly is called the compression volume.

It is apparent that the arc is powerfully blasted only in the area near its roots which spring from the moving contact 8A. Thus, to obtain efficient quenching of arcing from large currents, requires a considerable jet of gas from the compression volume and duct 13, 14. Yet the greater the gas blast, the greater the energy required to deliver the blast, which must overcome the back-pressure on the piston 12.

It is the object of this invention to improve the blasting effect without increasing the actuating energy.

It has been proposed to improve blasting efficiency by arranging the thermal and compression volumes to each side of the arcing region.

Such an approach is described in German patent applications Nos. 1 127 442 and 29 48 976 and in French Pat. No. 2 373 141.

However, in the circuit breakers described in the foregoing documents, the gases coming from the two volumes are brought together prior to reaching the arcing region, with the result that only a small improvement in blasting or blow-out efficiency is provided.

One of the features of the present invention is that the gases coming from the thermal and the compression volumes are routed through nozzles which direct separate blasts to each of the arc roots respectively.

SUMMARY OF THE INVENTION

The invention provides a compressed gas type high voltage circuit breaker comprising a first volume in which pressure increases from heating by the breaking arc, the gas in this volume escaping to blow out the arc at current zero of the current being interrupted, and a second volume in which the gas is compressed by a piston at the beginning of the breaker opening phase and directed at the arc during the following phases, said circuit breaker comprising main stationary or fixed contacts, fixed arcing contacts, main moving contacts and moving arcing contacts, the arc extending between the two arcing contacts during breaker opening, the first volume and second volume being disposed to each side of the arcing region, wherein said circuit breaker said gas volumes are annular and terminate in nozzles aiming separate jets of gas at the two respective roots of the arc.

The invention will now be described in greater detail in terms of one preferred embodiment given by way of example, with reference to the appended drawings.

DESCRIPTION OF THE PREFERRED EMBODIMENT

Figure 1:
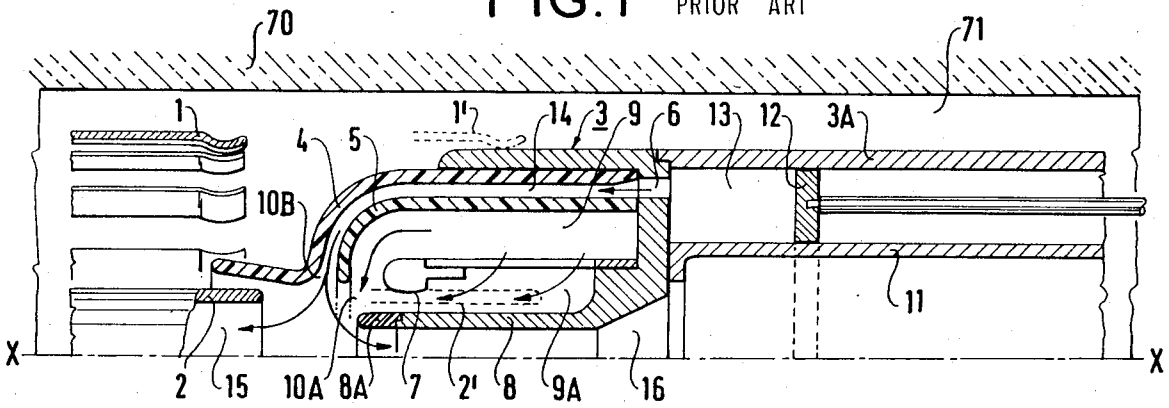
FIG. 1 PRIOR ART
FIG. 1 is a view, taken in axial cross-section, of a portion of a gas-blast circuit breaker according to the prior art.
Figure 2:
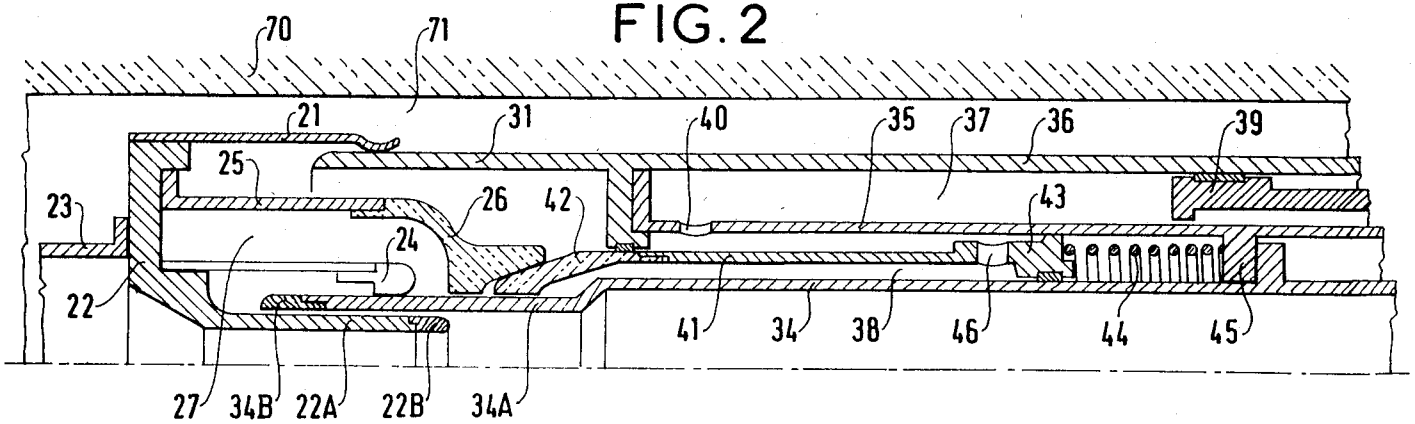
FIGS. 2 through 6 are cross-sectional views of a portion of a circuit breaker according to one preferred embodiment of the invention, showing various portions in the process of breaker opening.

FIG. 2 provides a view of a portion of the circuit breaker in closed position. The figure shows the device's ceramic outer case 70 and the circuit breaking assembly arranged coaxially inside the case, with an annular space 71 separating it from the case. The set of fixed contacts includes the main contact fingers 21 attached to a contact-holder 22 connected to a contact tube 23; the contact-holder 22 also supports the fingers of the arcing contacts 24 and extends towards the centerline of the circuit breaker to form a cylindrical part 22A ending in a section 22B made of a material designed to withstand the effects of electric arcs.

The contact-holder 22 also serves as a support for an axial cylindrical sleeve 25 which ends in an insulating nozzle 26.

The sleeve 25 and the nozzle 26, together with the cylindrical part 22A, define a cylindrical volume or thermal chamber 27 of annular cross section which acts as the thermal volume during breaker opening, as will be explained hereinafter.

The moving assembly altogether comprises:

a contact tube 31 cooperating with the main fixed contacts 21 when the circuit breaker is closed; and a tube 34, coaxial with tube 31 and terminating in an arcing-contact cylinder 34A the end portion whereof 34B is made of a material designed to withstand the effects of electric arcs, said tube cooperating with the arcing contacts 24 when the breaker is closed.

Tubes 31 and 34 are attached to one another and to a control rod which is not shown in the drawing.

A cylindrical wall 35 coaxial with tubes 31 and 34 contributes to defining two more annular cross section volumes or chambers 37 and 38.

Volume 38 houses a tube 41 one end of which is provided with an insulating nozzle 42 which comes to bear against nozzle 26 when the circuit breaker is closed.

The other end of tube 41 carries a piston 43 sealably sliding in volume 38.

The piston is urged forward by a spring 44 pushing against a step 45 in tube 35.

Said spring 44 is compressed when the circuit breaker is closed.

The two parts of volume or chamber 38, on each side of tube 41, communicate with each other via a plurality of orifices such as 46. Orifices 40 and 46 are so located that they become aligned when piston 43 is at the end of its stroke.

The circuit breaker according to the invention operates as follows:

When the circuit breaker is closed, current flows through tube 23, contacts 21 and tube 31.

Figure 3:
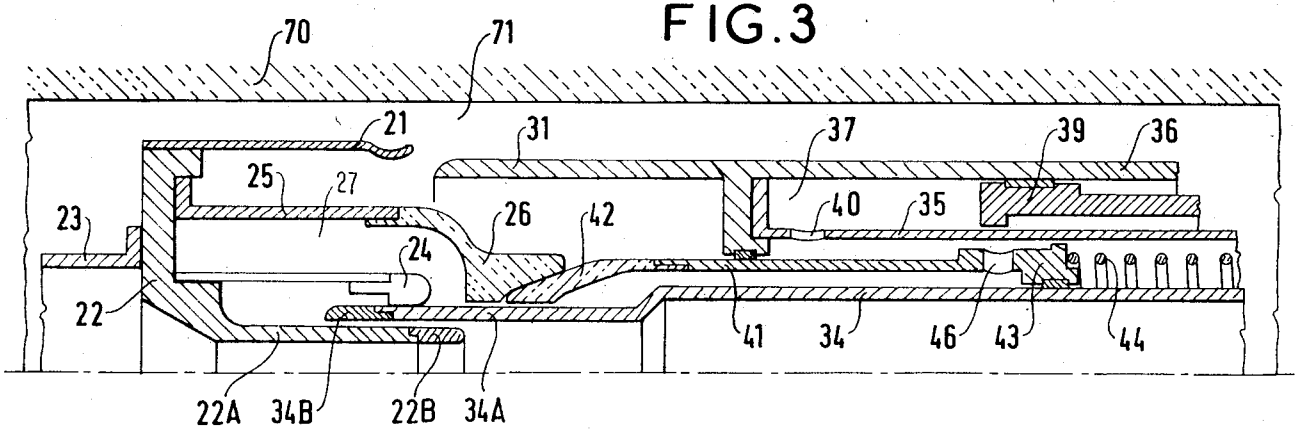

As the breaker opens (FIG. 3), by retraction of the moving assembly, the current is switched to the arcing contacts 24 and 34A.

Nozzle 42 stays in contact with nozzle 26 due to the action of the spring 44.

The gas in volume 37 begins to compress from the action of the fixed piston 39, with volumes 37 and 38 remaining closed by contacts 34A bearing against nozzle 42.

As the moving assembly continues its stroke (FIG. 4), the arcing contacts separate and an arc A forms between them.

Figure 4:
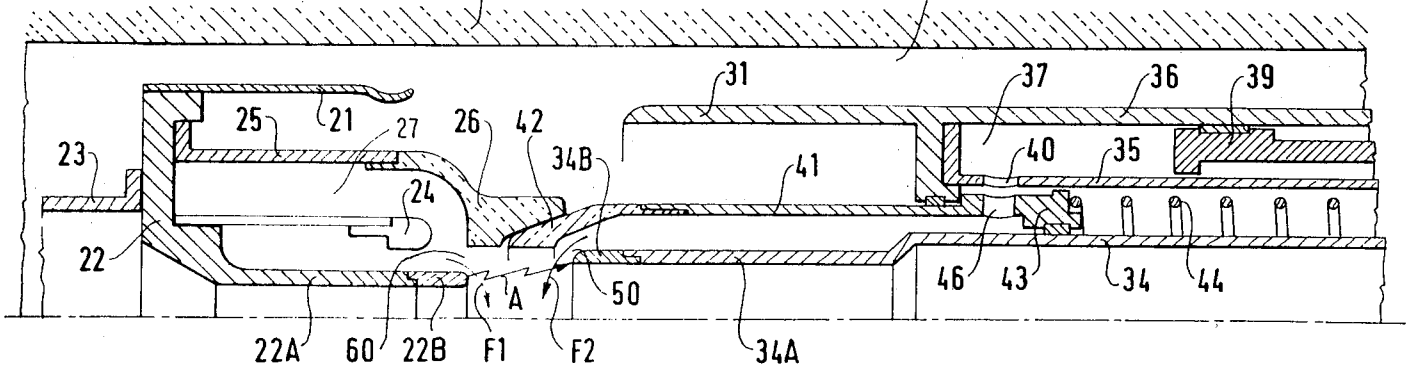

FIG. 4 illustrates the circuit interruption phase wherein the piston 43 reaches the end of its stroke whilst nozzle 42 still bears against nozzle 26.

At this point, nozzle 42 and arcing contact tube 34A have stopped moving relative to one another, establishing an annular opening 50 in which one of the roots of the arc begins to be quenched by the compressed gas forced thereon by piston 39.

Meanwhile, the gas in chamber 27, having been compressed from the heat of the arc, expands at the first current zero, which reduces the intensity of the arc, and also blasts the arc through the annular passage 60 formed between cylinder contact end 22B and nozzle 26, the opening of this annular passage being in a plane perpendicular to both the axis of the circuit breaker and the other annular opening 50.

The invention thus provides a double arc blow-out, the blasts being respectively directed to respective roots of the arc as shown by the arrows F1 and F2 in FIG. 4. The arc is powerfully blasted and the back-pressure on the piston is limited such that the energy required for opening is small.

Figure 5:
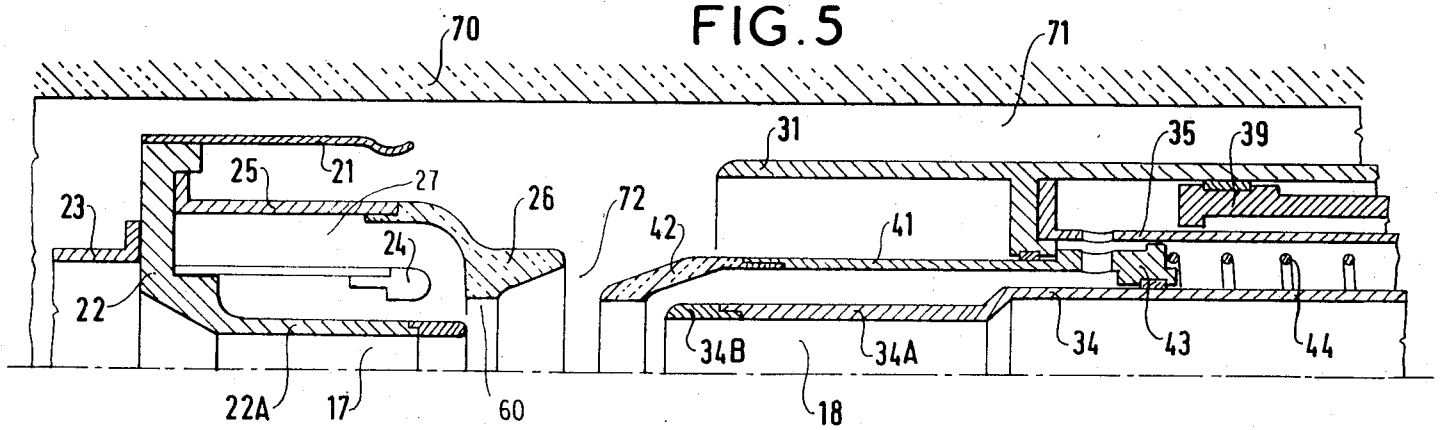

As the moving assembly continues its stroke (FIG. 5), nozzles 26 and 42 separate, thus clearing a large opening for the gases to escape towards space 71 and spaces 17 and 18 arranged concentrically to contacts 22A and 34 and permanently communicating with space 71.

Figure 6:
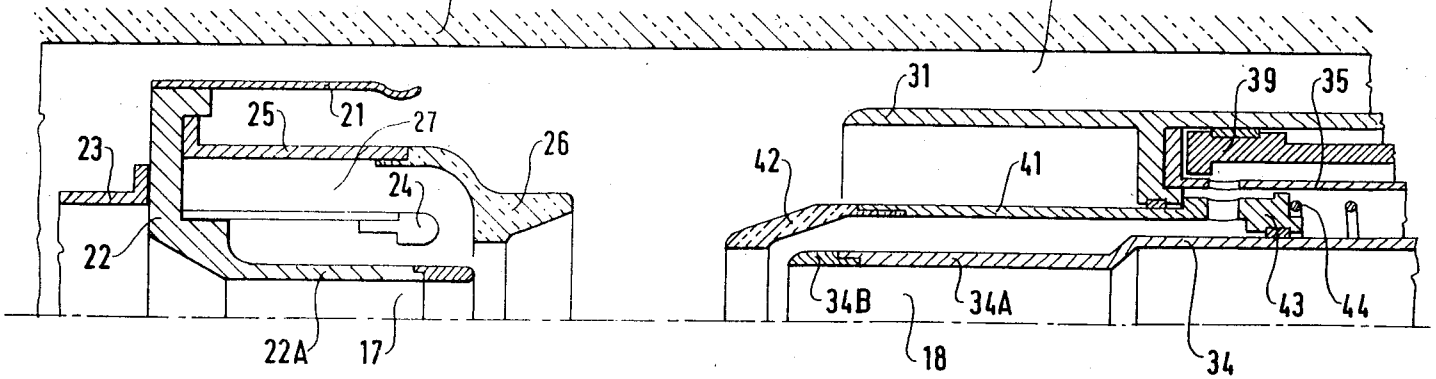

FIG. 6 shows the circuit breaker as configured at the end of the circuit interrupting stroke.

The large opening 72 ensures fast cooling of the gases.

I claim:

1. Gas-blast type high voltage circuit breaker comprising means defining a first chamber wherein gas pressure increases from heating by the breaking arc, means for causing the gas in said chamber to escape said first chamber to blow out the arc at current zero of the current being interrupted, means including a piston defining a second compression gas chamber wherein gas is compressed by said piston at the beginning of the breaker opening phase and means for directing gas from said second chamber at the arc during the following phases, main fixed contacts, fixed arcing contacts, main moving contacts and moving arcing contacts, the arc extending between the two arcing contacts during breaker opening, the improvement wherein said first chamber and said second chamber are disposed to each side of the arcing region, are both annular-shaped and terminate in nozzles aiming separate gas jets at two respective roots of the arc.

2. Circuit breaker according to claim 1, wherein said first chamber is delimited by a tube coaxial with said fixed arcing contacts and an insulating nozzle, said second chamber is delimited by a first tube forming the main moving contact and a second tube, coaxial with said first tube, and said second chamber is closed at one end by a fixed piston.

3. Circuit breaker according to claim 2, wherein a third tube is mounted coaxially with said first and second tubes and forms the moving arcing contact and delimits, together with said second tube, an annular chamber in which a fourth tube, ending in a second insulating nozzle, moves, said fourth tube being driven by a piston actuated by one end of a spring whose other end abuts against a stop built onto the moving contacts, said third and fourth tubes defining a passage for the gas from said second chamber, and orifices provided in the second and fourth tubes for passing said gas from said second chamber.

4. Circuit breaker according to claim 3, wherein separation of said first and second insulating nozzles in the course of breaker opening occurs some time after the beginning of the stroke of the third (contact) tube as required for compression to take place in said first, thermal chamber.

5. Circuit breaker according to claim 3, wherein the opening of said first, thermal chamber is perpendicular to the axis of the circuit breaker and to the opening of said second, compression gas chamber.

6. Circuit breaker according to claim 4, wherein the opening of said first, thermal chamber is perpendicular to the axis of the circuit breaker and to the opening of said second, compression gas chamber.

* * * * *